United States Patent [19]

Cech et al.

[11] Patent Number: 4,494,578

[45] Date of Patent: Jan. 22, 1985

[54] WEFT BEAT-UP MECHANISM FOR LOOMS

[75] Inventors: Miloslav Cech; Adolf Slezak, both of Bruno; Vladimir Vasicek, Moravsky Krumlov, all of Czechoslovakia

[73] Assignee: Zvs Vyzkumnevyvojovy ustav, koncernova, Brno, Czechoslovakia

[21] Appl. No.: 479,946

[22] Filed: Mar. 29, 1983

[30] Foreign Application Priority Data

Mar. 29, 1982 [CS] Czechoslovakia ..... 2152-82

[51] Int. Cl.[3] ..... D03D 49/68

[52] U.S. Cl. ..... 139/188 A

[58] Field of Search ..... 139/188 R, 188 A, 189, 139/190, 191, 192

[56] References Cited

U.S. PATENT DOCUMENTS 1,840,892 1/1932 Garisio ..... 139/188 A

FOREIGN PATENT DOCUMENTS 601712 12/1925 France ..... 139/188

*Primary Examiner*—Henry S. Jaudon

[57] ABSTRACT

Weft beat-up mechanism for a loom. A reed for beating-up the weft toward the binding point at the front end of the fabric is mounted on a driven active member on the loom. The active member is pivotally mounted on the loom and its drive is coupled with the loom drive. The reed is mounted in a carrier which is mounted for limited swinging with respect to the active member, with the pivotal axis thereof parallel to the axis of the beat-up weft. The reed is constantly resiliently thrust by a power element, such as a coil compression spring, relative to the active member in a direction toward the binding point of the fabric. The mechanism of the invention increases the security of setting of the inserted weft, and reduces impact forces between the reed and the binding point of the fabric during the weaving process.

6 Claims, 7 Drawing Figures

WEFT BEAT-UP MECHANISM FOR LOOMS

The present invention relates to a weft beat-up mechanism for looms.

For the purpose of weaving fabrics in looms, weft is inserted in a known manner, e.g. by a shuttle, by an air jet, etc., into the shed formed by the separated upper and the lower warp threads. The inserted weft is thereafter beaten up by a reed in a direction toward the front end of the fabric and, simultaneously, the upper and lower warp threads are alternated. Upon finishing the beat-up, the reed, which is mounted on an active member, usually a sley arm mounted on the loom, is positively swung back into the weft inserting position. Due to the elasticity of the pre-fabric and of the warp threads, and also the insufficient weaving-in by the warp threads, even the newly inserted weft is partially returned toward its initially inserted position.

Only upon a further beat-up of the next following inserted weft thread, is the previously inserted weft thread advanced into its required final position. However, because the said formerly inserted weft thread has already been woven in, the warp threads contract extensively, due to the considerable beat-up force of the reed. The beat-up force is thus enhanced, together with the contracting warp and the firmness of setting the inserted weft. However, the beat-up force is limited by the size of the reed, as well as by the material of which both the weft and the warp are made. Thus, the setting of the weft cannot be enhanced to an unlimited extent. The high beat-up force also imposes a considerable stress upon the other parts of the loom and also causes their oscillation, which acts unfavorably upon their service life, and the noisiness of the loom. The oscillations thus produced are transmitted to the loom frame and affect unfavorably the floor of the production shop. Moreover, the increasing noisiness frequently does not permit the operation speed of the loom to be increased.

Various kinds of beat-up mechanisms are known, as e.g. multiple beat-up mechanisms, in which the reed performs a plurality of beat-up operations instead of a single one. In that manner, the beat-up force can be reduced, and a higher weft contraction achieved. However, even with a two-fold beat-up, with the presently normal operating speed of 400 rpm of the loom, the reed must oscillate at a relatively high frequency; in view of the oscillating masses, i.e. the reed, the reed holder and the device for counterbalancing, this causes even higher forces than in the original design with a single beat-up. Moreover, together with increasing beat-up frequency, the noisiness of the loom is also increased.

The said disadvantages and insufficiencies of the prior art are mitigated to a considerable extent by the weft beat-up mechanism according to the present invention. In accordance with the invention, the reed is mounted in a carrier which is mounted on an active member for pivoting within a limited extent with respect thereto, the pivotal axis being parallel to the axis of the beaten-up weft. Until its engagement with the weft thread the reed is thrust forwardly by a power element disposed between the active member and the reed carrier, thus extending the time during which the reed acts upon the inserted weft in the beat-up position of the active member.

The main advantages of the present invention consists in obtaining a more forceful weft setting and in reducing the impact forces exerted by the reed. The rate of oscillation of the beat-up mechanism is reduced, and consequently the vibration of the whole loom; this acts favorably on the lifetime of the loom elements, and causes the reduction of the noisiness of the loom, and the reduction of the stressing of both the warp and the weft threads.

Preferred embodiments of the present invention in form of preferred examples are shown in the accompanying drawings, in which.

Figure 2:
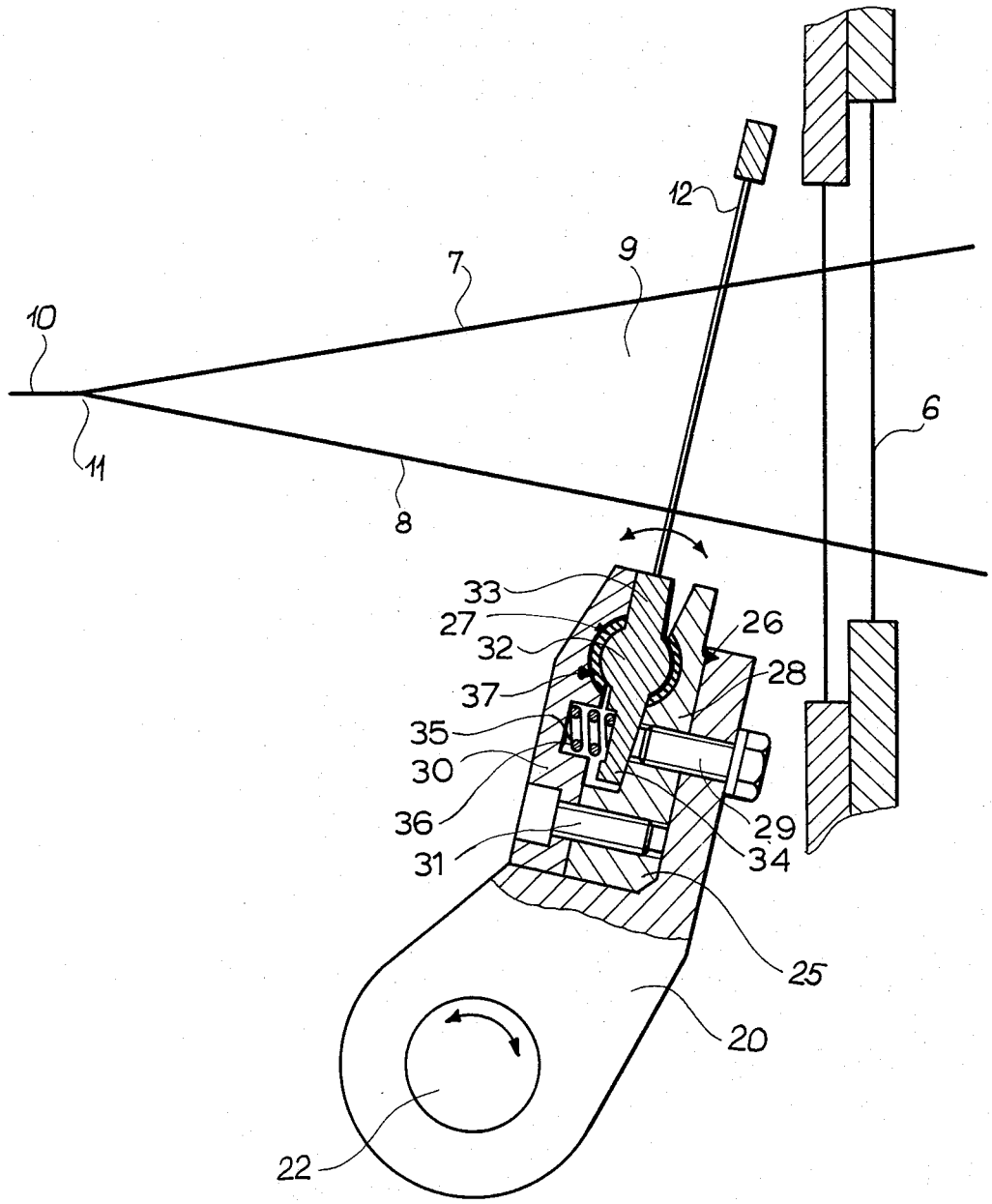
FIG. 2 is a fragmentary view partially in side elevation and partially in section of the beat-up mechanism of a first exemplary embodiment.
Figure 3:
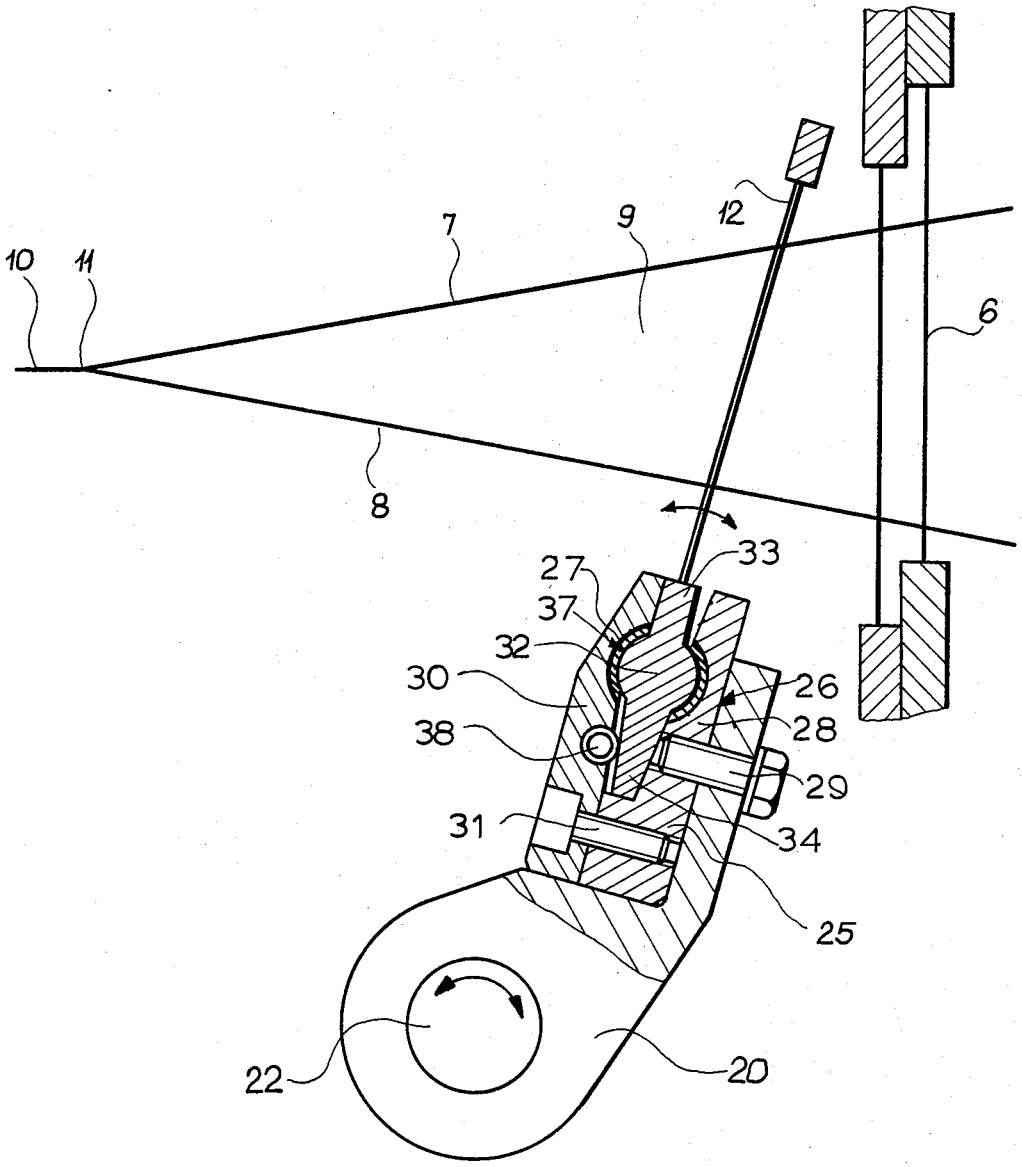
FIG. 3 is a view similar to FIG. 2 of a weft beat-up mechanism of a second exemplary embodiment.
Figure 3A:
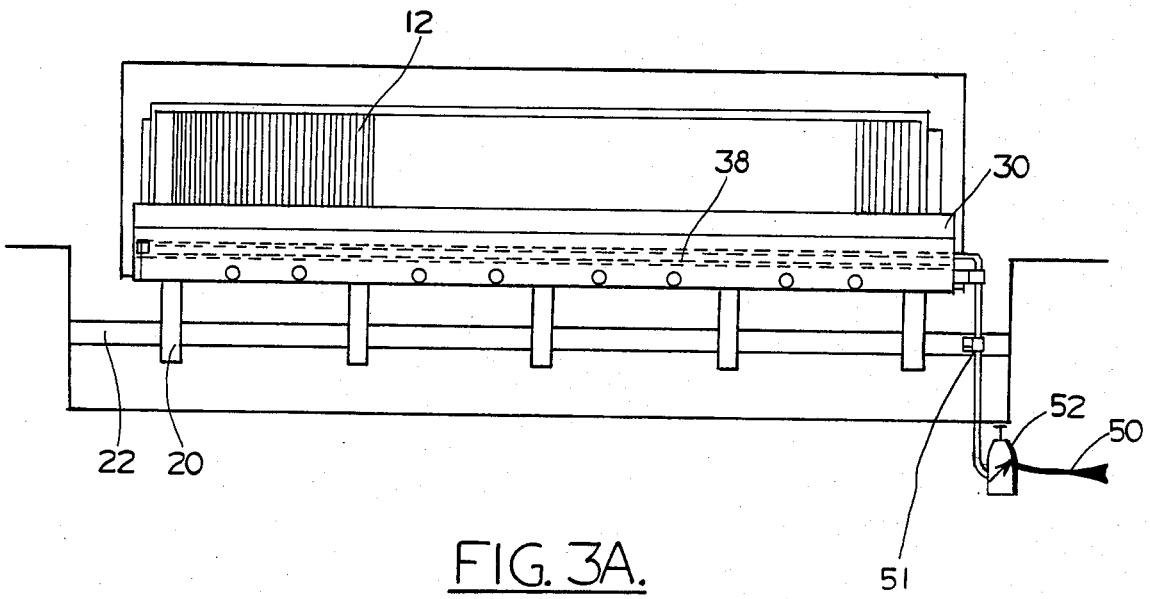
Figure 4:
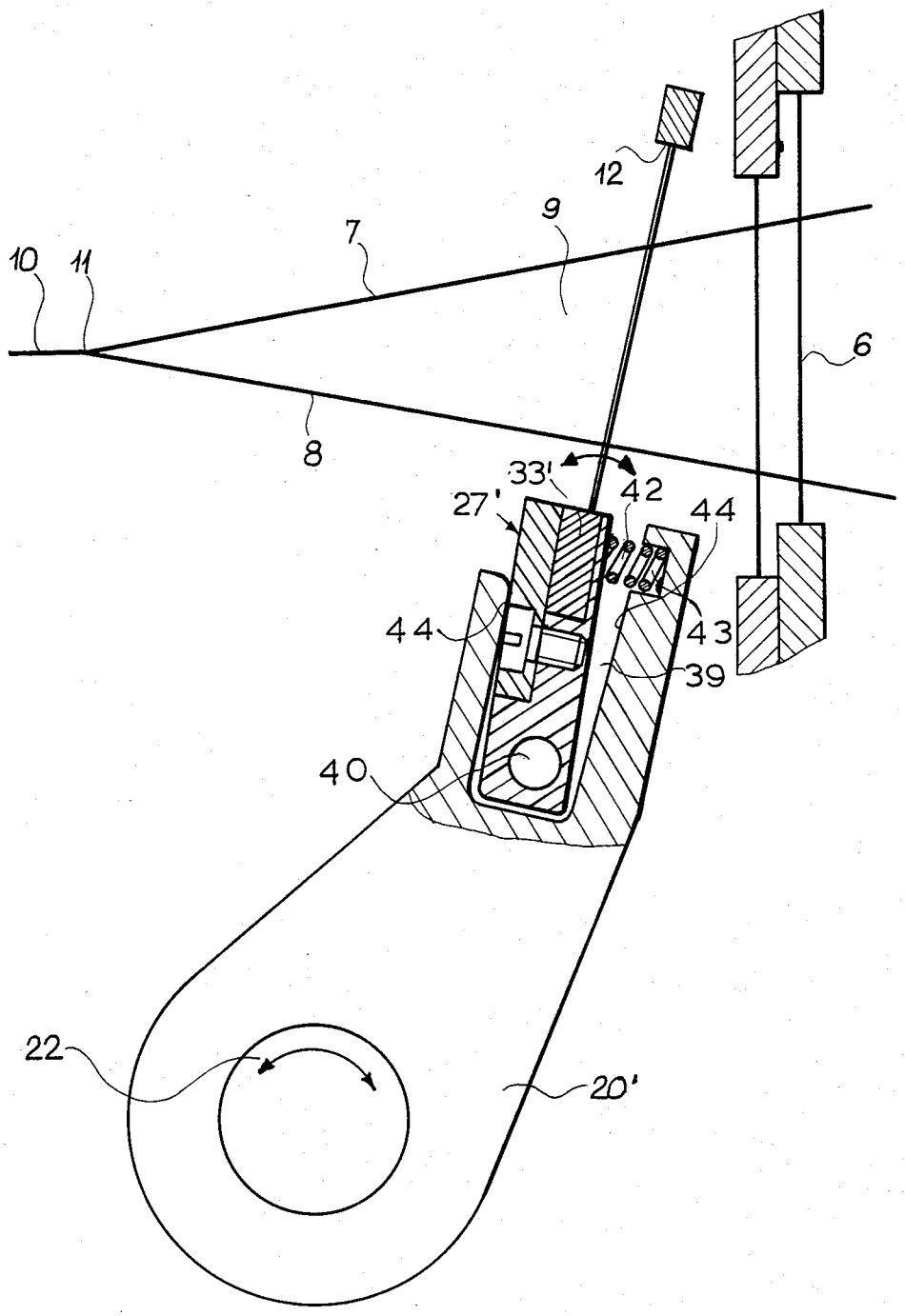
Figure 5:
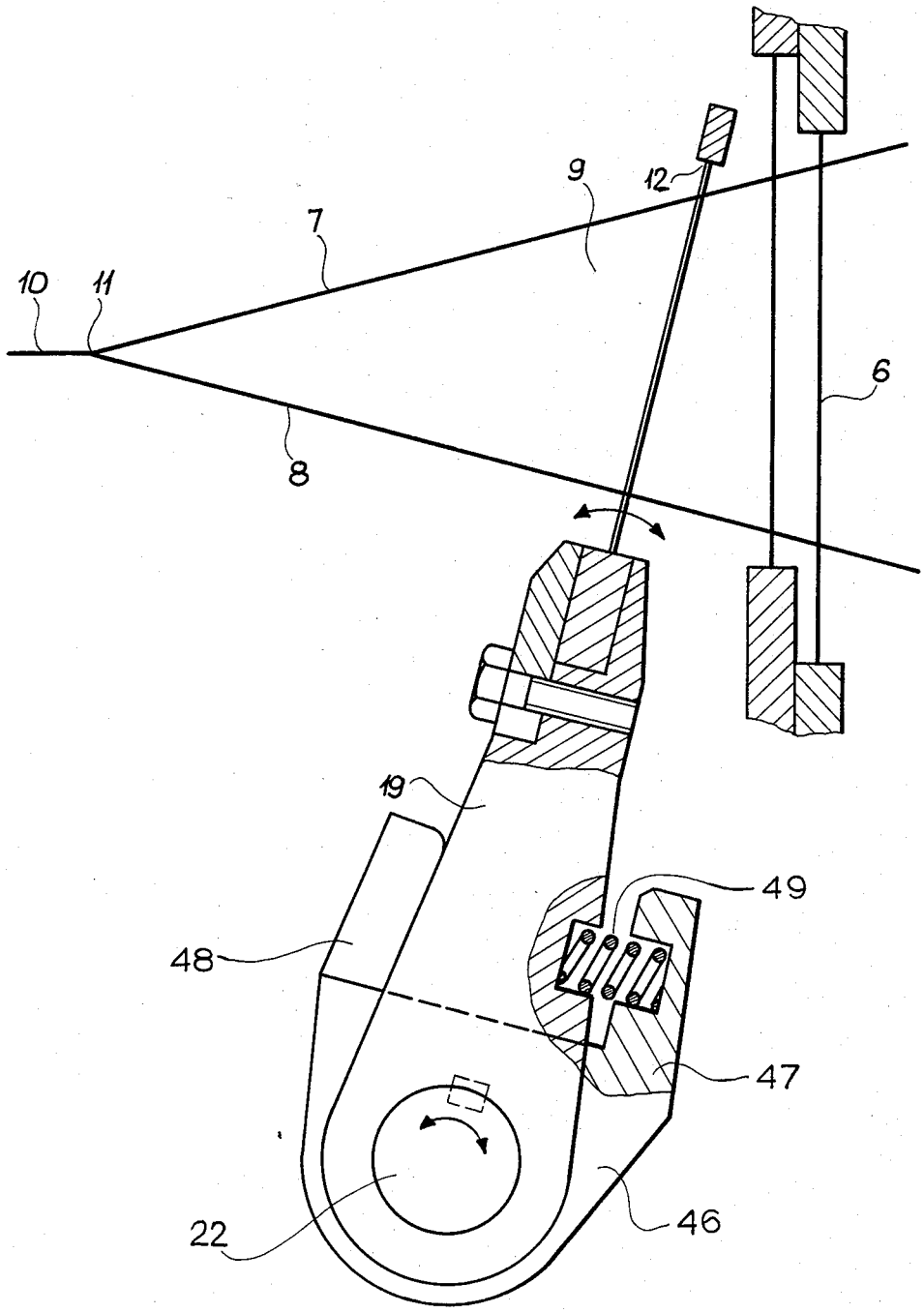
Figure 6:
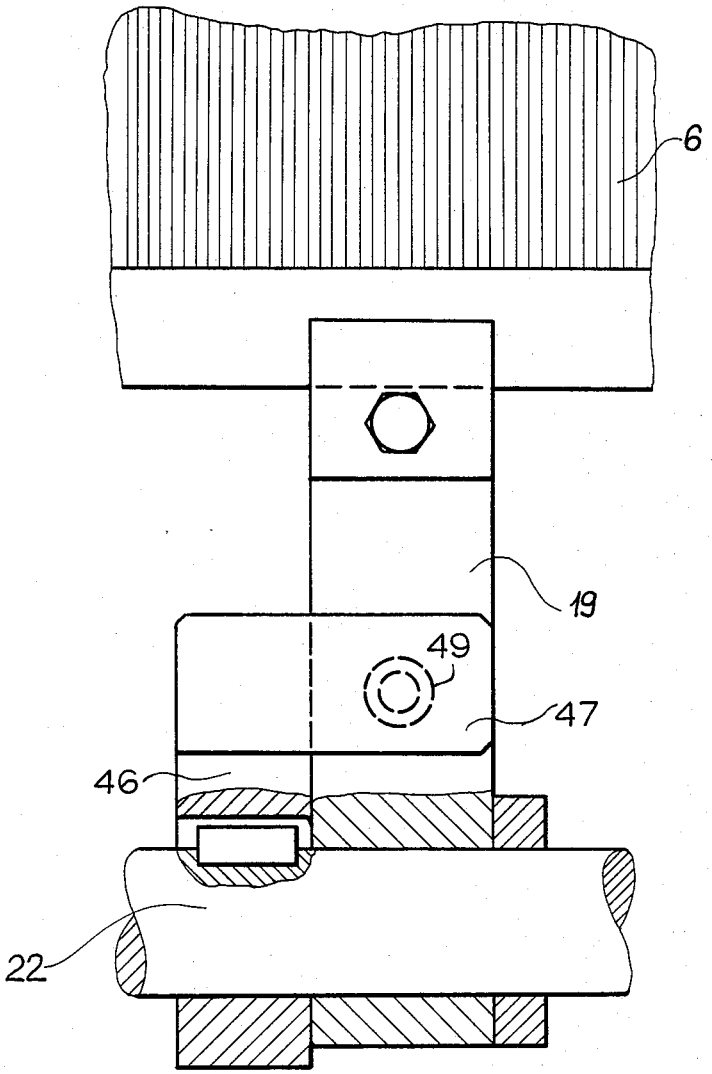

FIG. 3*a* is a fragmentarily view in end elevation of the structure shown in FIG. 3;

FIG. 4 is a view similar to FIG. 2 of the weft beat-up mechanism of a third embodiment;

FIG. 5 is a view similar FIG. to 2 of a fourth exemplary embodiment of a weft beat-up mechanism; and FIG. 6 is a view partially in vertical section and partially in side elevation of the exemplary embodiment of the mechanism shown in FIG. 5, the elevation being taken in the direction from left to right in FIG. 5.

Figure 1:
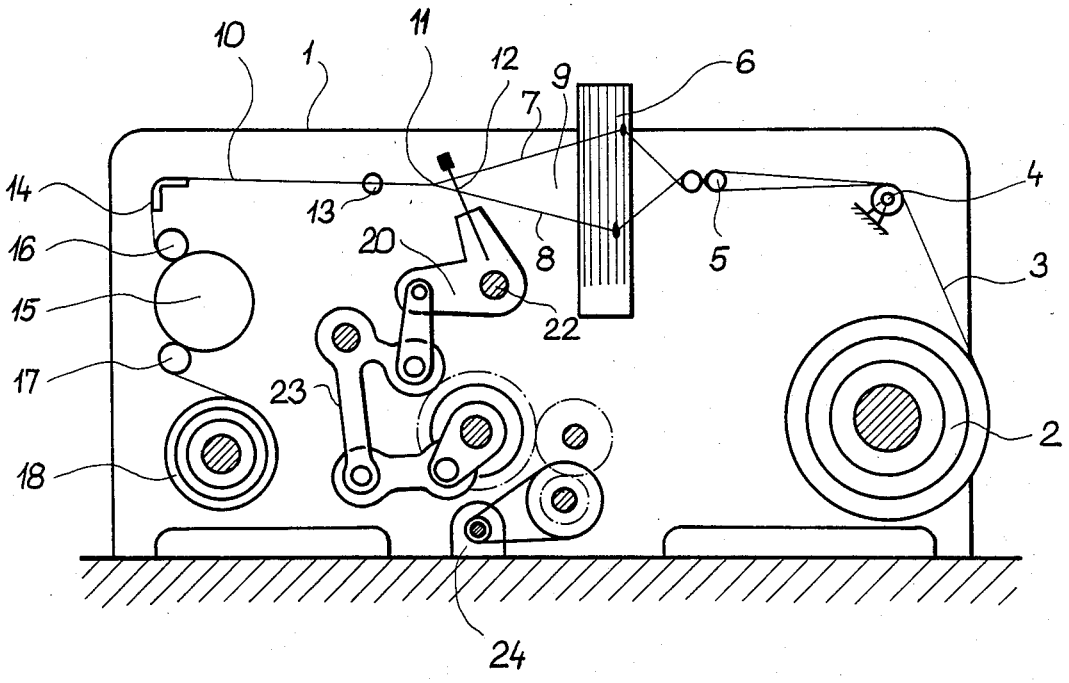
FIG. 1 is a view partially in side elevation and partially in vertical longitudinal section of the overall diagrammatical arrangement of a loom.

An exemplary overall arrangement of a loom with a weft beat-up mechanism according to the present invention is shown in FIG. 1. The frame 1 of the machine with its not specifically shown sidewalls, carries all operative movable mechanisms and the mechanism of the loom itself. In the rear (right) part of the loom there is rotatably mounted a warp beam 2, from which warp threads 3 are guided via a back rail 4 and lease bars 5 to healds 6, which distribute alternatingly the warp threads 3 into upper and lower branches 7, 8, thus forming a shed 9 in accordance with the predetermined weaving rhythm. By means of a schematically shown mechanism, the inserted weft thread is beaten up into the fabric 10 being formed at the binding point 11 by means of a reed 12. The fabric 10 being formed is guided further via temples 13 to a breast beam 14 and therefrom via a fabric roller 15 with pressing rollers 16, 17 to a cloth beam 18.

Reed 12 is mounted in a carrier 27 which is mounted on an active driven member 20 which pivots to a limited extent, with the pivotal shaft 22 thereof disposed parallel to the axis of the beaten up weft; said reed is under the action of a yieldable thrusting element, shown in various embodiments thereof in FIGS. 2–6, incl., until engagement of the reed with the inserted weft. This power element is arranged substantially between the active member 20 and the carrier 27 of reed 12. The active element 20 is mounted on the swingable shaft 22 and is coupled with its drive e.g. by means of a known link mechanism 23 with the drive 24 of the loom. By means of the said mechanism 23, active member 20 is positively swung out together with reed 12 into the beat-up position, in which the inserted, weft is beaten up by reed 12 into the fabric 10 being formed at the binding point 11.

In the exemplary embodiment shown in FIG. 2, the active member 20, which is affixed to the swingable shaft 22, is provided with a recess 25 for receiving a means 26 which pivotally mounts the carrier 27 for the reed 12. Mounting means 26 has a first part 28 which is secured to the active member 20 by a first stud 29, and a second, confronting member 30 which is secured to part 28 by a second stud 31. The carrier 27 is in the form of a first-class lever and has a central part-circular cylindrical part 32, an upper arm 33 to which reed 12 is connected, and a lower arm 34. The central part 32 of carrier 27 is pivotally received in a part-journal bearing 37 made up of confronting part-cylindrical bearing parts disposed in recesses in the upper portions of members 28 and 30.

A recess 35 is provided in part 30 of the mounting means 26, such recess receiving a power element in the form of a coil compression spring 36 which is held in compression between the bottom of the recess 35 and the confronting surface of a lower arm 34 of the carrier 27. It will be seen that the spring constantly urges the carrier 27 and the reed 12 carried thereby in a direction counterclockwise (FIG. 2) with respect to the member 20, space being provided between parts 28 and 30 of the mounting means 26 to permit the carrier 27 to oscillate to a limited degree with respect to the active member 20.

In FIG. 3 parts there shown which are similar to those in FIG. 2 are designated by the same reference characters. The embodiment of FIG. 3 differs essentially from that of FIG. 2 as to the character of the yieldable element which constantly urges the carrier 27 to rotate in a counterclockwise direction with respect to the active member 20. In FIG. 3 such part, shown at 38, which replaces the spring 36 of FIG. 2, is formed e.g. as an elastic pressure tube connected to a source of pressure fluid (not shown). By controlling the pressure inside tube 38, it is possible to adjust the counterclockwise directed torque imposed upon carrier 27 with respect to active member 20, so as to adjust the beating power of reed 12 to an optimum value. This adjustment can take place even when the loom is operating when the source of fluid pressure is connected to the tube 38 by a flexible conduit or hose.

In FIG. 3*a* there is shown the embodiment of FIG. 3 mounted in a fragmentarily shown loom. The horizontal switch is the same as those in FIG. 3 are designated by the same reference characters in FIG. 3*a*. There is provided air under pressure through a flexible tube 50 in which there is interposed a pressure regulating valve 52. Tube 38 is fastened to shaft 22 by a clamp 51, and proceeds thereafter along the length of the member 30.

In the exemplary embodiment shown in FIG. 4, the base member 33' for the reed 12 is mounted on a carrier 27' which is swingably mounted in a recess 39 in the upper end of the member 20' on a pivot pin 40. Between one wall 41 of recess 39 and the carrier 27' a power element in the form of a coil compression spring 42 is arranged. The other wall 44 of recess 31 forms a stop to limit the counterclockwise swinging of the carrier 27' with respect to the active member 20'.

In a further exemplary embodiment as shown in FIGS. 5 and 6, the carrier 19 of reed 12 is pivotally mounted on the swingable shaft 22. An active member 46, which is fixedly connected to the swingable shaft 22, is provided with two spaced arms 47 and 48 between which the carrier 19 is swingably mounted. Between one arm 47 and carrier 19 there is mounted a power element 49 in the form of a coil compression spring, while the other arm 48 forms a stop limiting the swingable mounting of the carrier 19 of reed 12 on the active member 46.

The mechanism according to the above-described exemplary embodiments operates in such manner that, upon inserting the weft thread into shed 9, the active member 19 is turned together with the swingable shaft 22, the former driving the reed 12 toward the binding point 11 together with the last inserted weft thread. Upon beat-up of the weft thread against the fabric 10, reed 12 is stopped. However, active member 19 is further swung out, and thus carrier 12 begins to act against the power element, the spring or the inflatable tube, for example, thus gradually increasing the beat-up force to its maximum. After finishing the beat-up, active member 20 starts moving backwardly. During such backward movement of active member 20 the power element (the spring or inflatable tube) extends and holds the reed in contact with the last laid weft; during this part of the weaving cycle the beat-up force of reed 12 on the weft thread is gradually reduced until the reed ceases to engage the weft, when the weft reaches its terminal counterclockwise position with respect to the active member 20. Only after the reed has reached its terminal counterclockwise position with respect to the active member 20 does the reed begin to move. This means that the weft is held until the beginning of the backward movement of reed 12, such backward movement of the reed beginning after the interchanging of the branhes of the warp threads. This insures the interlacing of the weft directly at the face of fabric 10 so that the weft cannot be loose, that is, it cannot be released from the binding point 11 of the fabric 10.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. In a weft beat-up mechanism for a loom, said mechanism including a positively driven oscillatable active member mounted on the loom, a reed mounted on the active member for beating up the weft to the front end of the fabric in the beat-up position of the active member, the improvement wherein the reed is mounted on a carrier, and comprising means mounting the carrier on the active member to permit swinging of the carrier to a limited extent abut a pivotal axis with respect to the active member, the pivotal axis being parallel to the axis of the beaten-up weft, and yieldable means acting between the carrier and the active member for constantly urging the carrier and the reed thereon forwardly on the loom with respect to the active member, whereby to prolong the time during which the reed acts upon the inserted weft in the beat-up position of the active member, the reed being swingably mounted in a recess, having spaced opposite walls in the active member, on a pivot pin mounted therein, the yieldable means being arranged between the carrier and one wall of such recess, the other wall of the recess forming a limiting stop for the carrier of the reed in its swinging with respect to the active member.

2. Weft beat-up mechanism as claimed in claim 1, wherein the resilient means is made in the form of a pressure spring.

3. Weft beat-up mechanism as claimed in claim 1, wherein the resilient means is made in the form of a pressure tube connected to a fluid pressure source.

4. In a weft beat-up mechanism for a loom, said mechanism including a positively driven oscillatable active member mounted on the loom, a reed mounted on the active member for beating up the weft to the front end of the fabric in the beat-up position of the active member, the improvement where the reed is mounted on a carrier, and comprising means mounting the carrier on the active member to permit swinging of the carrier to a limited extent about a pivotal axis with respect to the active member, the pivotal axis being parallel to the axis of the beaten-up weft, and yieldable means acting between the carrier and the active member for constantly urging the carrier and the reed thereon forwardly on the loom with respect to the active member, whereby to prolong the time during which the reed acts upon the inserted weft in the beat-up position of the active member, the carrier for the reed being swingably mounted on the swingable shaft which mounts the active member, said active member being provided with two arms between which the carrier is mounted, and the resilient means being mounted between one arm and the carrier, while the other arm forms a limiting stop for the swinging motion of the carrier with respect to the active member.

5. Weft beat-up mechanism as claimed in claim 4, wherein the resilient means is made in the form of a spring.

6. Weft beat-up mechanism as claimed in claim 4, wherein the resilient means is made in the form of a pressure tube connected to a fluid pressure source.

* * * * *